US011397410B2

(12) United States Patent
Bravo

(10) Patent No.: US 11,397,410 B2
(45) Date of Patent: Jul. 26, 2022

(54) DEVICE FOR AUTONOMOUS ADJUSTMENT OF THE ACTIVE LENGTH OF A BALANCE SPRING

(71) Applicant: The Swatch Group Research and Development Ltd, Marin (CH)

(72) Inventor: Paulo Bravo, Marin-Epagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 891 days.

(21) Appl. No.: 16/221,664

(22) Filed: Dec. 17, 2018

(65) Prior Publication Data

US 2019/0187618 A1 Jun. 20, 2019

(30) Foreign Application Priority Data

Dec. 20, 2017 (EP) ..... 17208988

(51) Int. Cl.
*G04B 18/02* (2006.01)
*G04B 18/04* (2006.01)
(Continued)

(52) U.S. Cl.
CPC ..... *G04B 18/023* (2013.01); *G04B 17/063* (2013.01); *G04B 17/26* (2013.01);
(Continued)

(58) Field of Classification Search
CPC ..... G04B 17/063; G04B 17/26; G04B 17/28; G04B 18/02–028; G04B 18/04
See application file for complete search history.

(56) References Cited

U.S. PATENT DOCUMENTS 395,351 A * 1/1889 Richmond ..... G04B 18/023 368/170
861,884 A * 7/1907 Ohlson ..... G04B 17/066 368/175
(Continued)

FOREIGN PATENT DOCUMENTS

CH 705 605 A2 10/2016
CH 705 605 B1 10/2016
(Continued)

OTHER PUBLICATIONS

Combined Chinese Office Action and Search Reort dated Jun. 23, 2020 in Patent Application No. 201811492233.2 (with English translation of categories of cited documents), 7 pages.
(Continued)

*Primary Examiner* — Daniel P Wicklund
(74) *Attorney, Agent, or Firm* — Oblon, McClelland, Maier & Neustadt, L.L.P.

(57) ABSTRACT

A device for autonomous adjustment of the active length of a balance spring includes a regulator mounted on a plate with a cock, a balance spring stud holder being pivotally mounted on the cock, the regulator being pivotally mounted on the stud holder and including a pivot arm and device for changing the active length of the balance spring by pivoting the regulator. The device includes an elastic stress device to exert an elastic, return-to-position action on the regulator, and an inertia block, mounted for free rotation on the cock and connected to the pivot arm of the regulator, arranged to move the pivot arm of the regulator between a rest position and a correction position of the device, and simultaneously act on the device for changing the active length of the balance spring.

28 Claims, 3 Drawing Sheets

(51) Int. Cl.
*G04B 17/06* (2006.01)
*G04B 17/26* (2006.01)
*G04B 17/28* (2006.01)

(52) U.S. Cl.
CPC ..... *G04B 17/28* (2013.01); *G04B 18/02* (2013.01); *G04B 18/04* (2013.01)

(56) References Cited

U.S. PATENT DOCUMENTS 1,103,551 A * 7/1914 Wachtelhausen .... G04B 18/026 368/176
2,088,421 A * 7/1937 Kohlhagen ..... G04B 18/02 968/117
2,508,940 A * 5/1950 DuBois ..... G04B 18/02 968/117
2,782,591 A * 2/1957 Guida ..... G04B 18/021 968/118
2,982,086 A * 5/1961 Loretan ..... G04B 17/26 368/175
3,136,116 A * 6/1964 Walton ..... G04B 18/02 968/117
3,442,074 A * 5/1969 Ringger ..... G04B 18/023 368/170
3,451,212 A * 6/1969 Marti ..... G04B 18/023 368/173
2005/0013201 A1* 1/2005 Muhle ..... G04B 18/023 368/175
2006/0062088 A1* 3/2006 Hintze ..... G04B 18/023 368/175
2015/0234352 A1 8/2015 Hessler et al.
2017/0212473 A1 7/2017 Wiederrecht

FOREIGN PATENT DOCUMENTS

CH 712225 A1 * 9/2017 ..... G04B 18/023
CN 104062884 A 9/2014
CN 104850000 A 8/2015
CN 104849994 B 12/2017
CN 106662840 B 5/2019
DE 24 21 750 A1 11/1975
EP 1798609 A2 * 6/2007 ..... G04B 17/325
EP 2 908 187 A1 8/2015

OTHER PUBLICATIONS

European Search Reort dated Jun. 7, 2018 in European Application 17208988.0 filed on Dec. 20, 2017 (with English Translation of Categories of Cited Documentation).

* cited by examiner

DEVICE FOR AUTONOMOUS ADJUSTMENT OF THE ACTIVE LENGTH OF A BALANCE SPRING

CROSS-REFERENCE TO RELATED APPLICATION

This application claims priority to European Patent Application No. 17208988.0 filed on Dec. 20, 2017, the entire disclosure of which is hereby incorporated herein by reference.

FIELD OF THE INVENTION

The invention concerns a device for autonomous adjustment of the active length of a balance spring, for an oscillator of the balance/balance spring type.

The invention also concerns a timepiece movement comprising the device for autonomous adjustment of the active length of a balance spring, for an oscillator of the balance/balance spring type.

The invention also concerns a timepiece, particularly a watch, including the timepiece movement.

BACKGROUND OF THE INVENTION

In the field of watches provided with mechanical oscillators of the balance/balance spring type, there are known manual devices for adjusting the active length of the balance spring.

For example, in ordinary manual adjustment mechanisms, the outer end of the balance spring is immobilised by a stud fixed to a stud holder integral with a cock. A regulator that is movable in rotation with respect to the stud holder is provided for adjusting the active length of the balance spring, thereby allowing the frequency of the balance/balance spring to be adjusted. The regulator is a pivoting lever, generally with two arms, centred on the axis of the balance staff. A first arm of the regulator carries, for example, two pins, between which the balance spring is free. A second arm of the regulator can be actuated manually to rotate the regulator through a certain angle about the balance staff. This allows the real position of the counting point to be changed. When the regulator pivots, the active length of the spring is reduced or increased. However, one drawback of such a manual adjustment device is that terrestrial gravity affects the oscillation frequency of the balance/balance spring as a function of the orientation of the corresponding timepiece movement. Thus, the rate of the watch may have a significant deviation of rate, especially between its horizontal and vertical positions. Further, when the balance spring moves between the pins because of play between the spring and the pins, the oscillations of the balance disturb its active length and thus cause a slight variation in the oscillation frequency of the balance/balance spring assembly.

To limit the negative effects of gravity a solution is known, in particular from Swiss Patent No CH70560561, which implements a device for adjusting the active length of the balance spring, wherein the regulator carries clamping means intended to clamp an end portion of the spring to define its active length. The outer end of the spring is also integral with an attachment system movably mounted relative to the regulator and arranged to cooperate therewith. The clamping means, formed for example of a pin/cam clamping system wherein the end portion of the spring is clamped, can be loosened or tightened at will by a watchmaker. When the watchmaker has loosened the pin/cam clamping system, he can move the attachment system using a tool, thereby moving the spring relative to the regulator, which remains fixed, and thus relative to the pin, which allows the active length of the spring to be changed. The watchmaker can then clamp the spring against the pin by tightening up the clamping system, to place the adjustment device in the operating position again. However, this solution remains a manual adjustment solution, which has the drawback of considerably limiting adjustment precision in compensating for the effects of gravity. Further, such a solution is tedious to implement, due to the various manual adjustment steps to be performed by a watchmaker for the adjustment.

SUMMARY OF THE INVENTION

It is an object of the invention to provide a device for adjusting the active length of a balance spring, for an oscillator of the balance/balance spring type, which makes it possible to offset, in a simple, precise and autonomous manner, the effects of gravity, particularly disturbances to the isochronism of the balance of the oscillator, and overcomes the aforementioned drawbacks of the state of the art.

To this end, the invention concerns a device for adjusting the active length of a balance spring, for an oscillator of the balance/balance spring type, which includes the features mentioned in the independent claim 1.

Specific embodiments of the adjustment device are defined in the dependent claims 2 to 13.

One advantage of the adjustment device according to the invention lies in the fact that it includes elastic stress means configured to exert on the regulator an elastic, return-to-position action, and an inertia block mounted for free rotation on the cock and connected to the pivot arm of the regulator. A rotation of the inertia block, subject to gravity, thus causes a displacement of the pivot arm of the regulator, between a position of rest and a correction position of the device, and simultaneously acts on the means for changing the active length of the balance spring, allowing the spring to be adjusted to offset disturbances to the isochronism of the balance caused by gravity. Consequently, the adjustment device according to the invention makes it possible to precisely adjust the operation of the oscillator as a function of its position in space, by offsetting disturbances to the isochronism of the balance caused by gravity, in an autonomous manner.

According to a preferred embodiment of the invention, the adjustment device further includes a cam driving the pivot arm of the regulator, said cam being integral with the inertia block and in contact with the pivot arm.

Advantageously, the cam is in contact with the pivot arm of the regulator regardless of the position of the inertia block. This makes it possible to permanently adjust the operation of the oscillator according to its position in space, and to further improve correction precision.

According to a particular embodiment of the invention, the elastic stress means include an elastically deformable arm, with a first end of the arm resting against a part integral with the cock and a second end of the arm being attached to the regulator.

Advantageously, the regulator, the pivot arm and the elastically deformable arm together form one piece. This both reduces the space required and improves the reliability of the adjustment device.

Advantageously, the adjustment device further includes means for adjusting the elastic stress defined by the elastic stress means. This allows a user to adjust the intensity of the elastic return action exerted on the regulator, according, for example, to the type of use desired for the watch provided with the adjustment device.

To this end, the invention also concerns a timepiece movement including the adjustment device described above, and which includes the features defined in the dependent claim 14.

To this end, the invention also concerns a timepiece comprising the timepiece movement described above, and which includes the features mentioned in the dependent claim 15.

BRIEF DESCRIPTION OF THE DRAWINGS

The objects, advantages and features of the device for adjusting the active length of a balance spring and of a timepiece comprising the same will appear more clearly in the following description based on at least one non-limiting embodiment, illustrated by the drawings, in which.

DETAILED DESCRIPTION OF THE INVENTION

In the following description, reference is made to a timepiece movement provided with a device for adjusting the active length of a balance spring, for an oscillator of the balance/balance spring type. The ordinary components of the timepiece movement, which are well known to those skilled in the art in this technical field, will be described only in a simplified manner or not described at all. Those skilled in the art will know how to adapt these different components and make them work together for the timepiece movement to operate. In particular, there will be no description below of anything relating to the escapement mechanism of the timepiece movement, although an escapement mechanism can advantageously cooperate with the adjustment device according to the invention.

Figure 1:
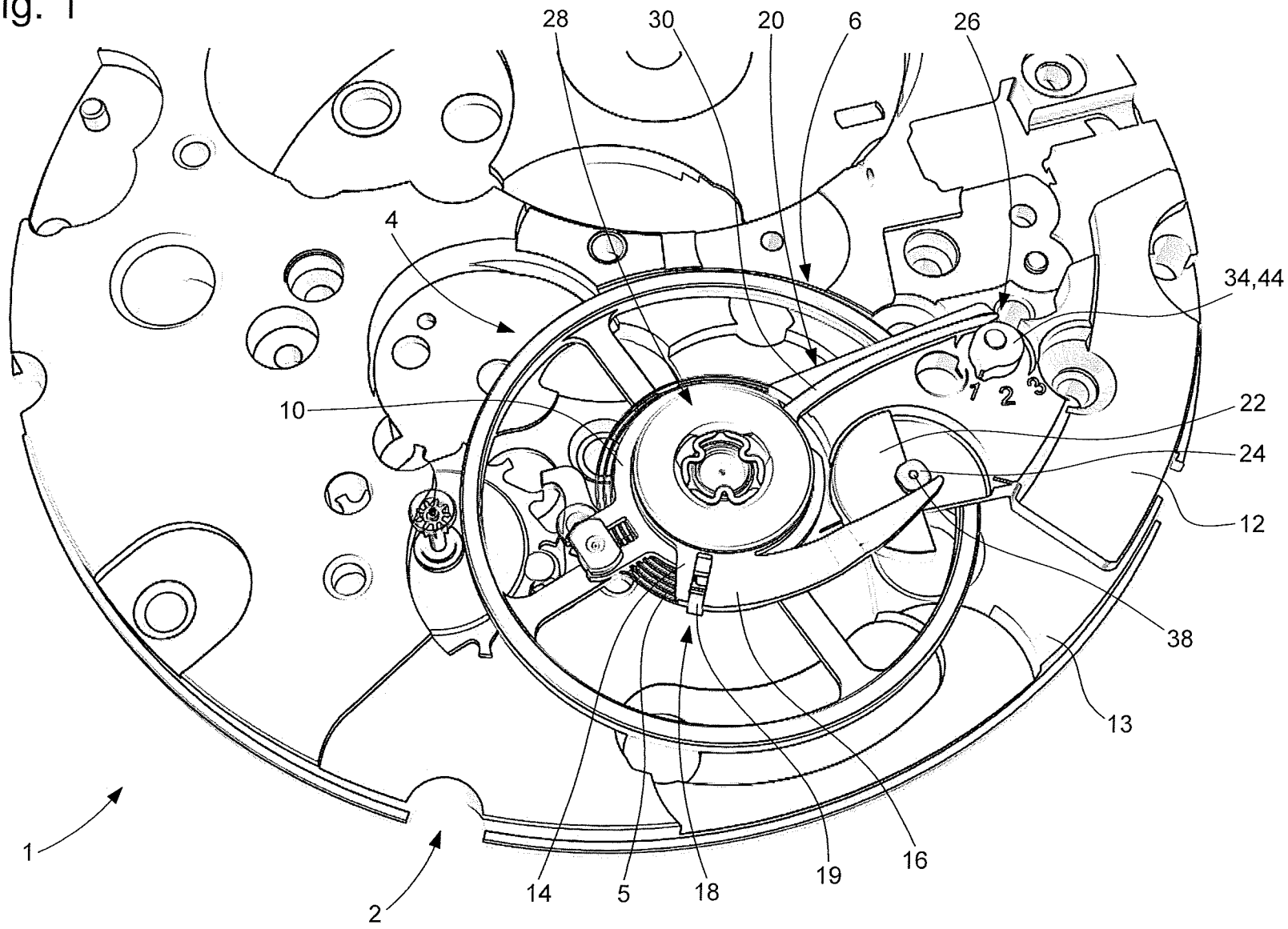
FIG. 1 is a perspective view of a timepiece movement of a watch including a mechanism for adjusting the active length of the balance spring according to the invention.
Figure 2:
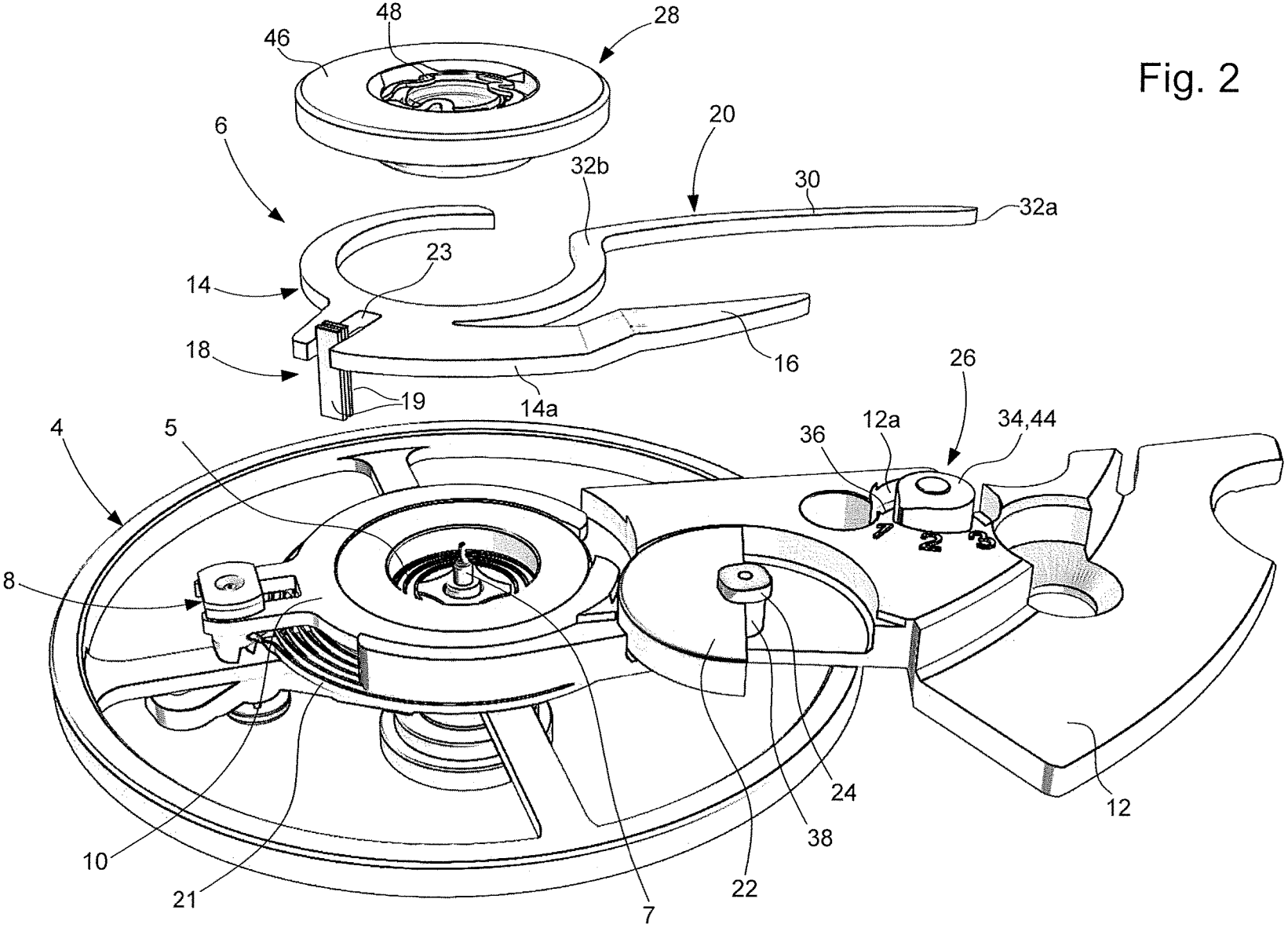
FIG. 2 is an exploded perspective view of the adjustment device of FIG. 1.

FIG. 1 represents part of a timepiece 1 which includes a timepiece movement 2. In the particular example embodiment of FIG. 1, timepiece movement 1 is a watch. Timepiece movement 2 includes an oscillator with a balance 4 and a balance spring 5, and a device 6 for autonomous adjustment of the active length of balance spring 5. In a conventional manner, balance spring 5 is attached to a staff 7 of balance 4 by its inner end (not visible). Staff 7 of balance 4 has one end pivotally mounted in a balance bar (the latter is not visible in the Figures for the sake of clarity). The outer end of balance spring 5 is attached in a conventional manner to a stud 8 fixed to a stud holder 10, stud holder 10 being lightly clamped to a cock 12. More precisely, stud holder 10 is pivotally mounted on cock 12 concentrically to staff 7 of balance 4, as illustrated in FIG. 2. Staff 7 of balance 4 is pivotally mounted in cock 12.

Adjustment device 6 is mounted on a frame 13 of timepiece movement 2 via cock 12 and includes a regulator 14. As represented in FIG. 2, regulator 14 is pivotally mounted on stud holder 10 concentrically to staff 7 of balance 4. Regulator 14 includes a pivot arm 16 and means 18 for changing the active length of balance spring 5.

Means 18 for changing the active length of balance spring 5 are capable of changing the active length of balance spring 5 by pivoting regulator 14. In the particular example embodiment illustrated in FIG. 2, means 18 for adjusting the active length of balance spring 5 include two pins 19 fixed to regulator 14. Balance spring 5 is arranged such that an outer coil 21 of balance spring 5 passes between the two pins 19. The two pins 19 act like a vice for outer coil 21 and are oriented along a plane substantially perpendicular to frame 13 of timepiece movement 2, in other words along a substantially vertical plane when timepiece movement 2 extends in a horizontal plane. As illustrated in FIG. 2, the upper ends of the two pins 19 are, for example, pressed into a slot 23 arranged in regulator 14, which allows pins 19 to be attached to regulator 14. Lower main portions of pins 19 thus extend from a lower face 14*a* of regulator 14, allowing outer coil 21 of balance spring 5 to be arranged between said lower main portions. In the particular example represented in FIG. 2, pins 19 have a substantially parallelepiped shape. However, any shape other than the parallelepiped shape could be envisaged for pins 19 within the scope of the present invention.

Adjustment device 6 further includes elastic stress means 20 and an inertia block 22. In a preferred example embodiment, adjustment device 6 further includes a cam 24 for driving pivot arm 16 of regulator 14. Preferably, adjustment device 6 may also include means 26 for adjusting the elastic stress defined by elastic stress means 20, and shock absorption means 28.

Elastic stress means 20 are configured to exert an elastic, return-to-position action on regulator 14. More precisely, elastic stress means 20 are configured to exert on regulator 14 an elastic return action to a rest position of adjustment device 6 illustrated in FIG. 3. According to a particular example embodiment, elastic stress means 20 include an elastically deformable arm 30. A first end 32*a* of arm 30 abuts against a part 34 integral with cock 12, placing arm 30 under elastic stress. To facilitate this elastic stress arrangement, cock 12 can, for example, be provided with a support and guide rim 36 for deformable arm 30 on a lateral surface 12*a*. Part 34 is, for example, formed of elastic stress adjusting means 26, as will be described in detail below, but may, in a variant, be formed of a pin integral with cock 12. A second end 32*b* of arm 30 is attached to regulator 14. Preferably, as represented in FIGS. 1 to 4, regulator 14, pivot arm 16 and elastically deformable arm 30 together form one piece. The one-piece part formed by regulator 14, pivot arm 16 and elastically deformable arm 30 substantially defines a U-shape, for example, with pivot arm 16 and elastically deformable arm 30 forming the two arms of the U.

According to a preferred embodiment, inertia block 22 is mounted for free rotation on cock 12 and is connected to pivot arm 16 of regulator 14 such that a rotation of inertia block 22 causes a displacement of pivot arm 16 of regulator 14 and simultaneously acts on means 18 for adjusting the active length of balance spring 5. The displacement of pivot arm 16 of regulator 14 caused by the rotation of inertia block 22, which is itself subject to gravity, is carried out between a rest position of device 6, illustrated in FIG. 3, and a correction position of device 6, illustrated in FIG. 4. As illustrated in FIGS. 1 to 4, inertia block 22 is, for example, formed of a half-solid disc. In a variant not represented in the Figures, inertia block 22 is formed of a bimaterial solid disc, wherein the two materials of the disc have distinct densities.

According to another embodiment, inertia block 22 is mounted for free rotation on plate 13.

In the preferred example embodiment, wherein device 6 includes a cam 24 driving pivot arm 16 of regulator 14, cam 24 is integral with inertia block 22 and is in contact with pivot arm 16. In a variant of this preferred example, illustrated in FIGS. 1 to 4, inertia block 22 is mounted for free rotation on cock 12 via an arbor 38 integral with inertia block 22. Cam 24 is mounted on inertia block 22 concentrically to arbor 38 and is integral with arbor 38.

Figure 3:
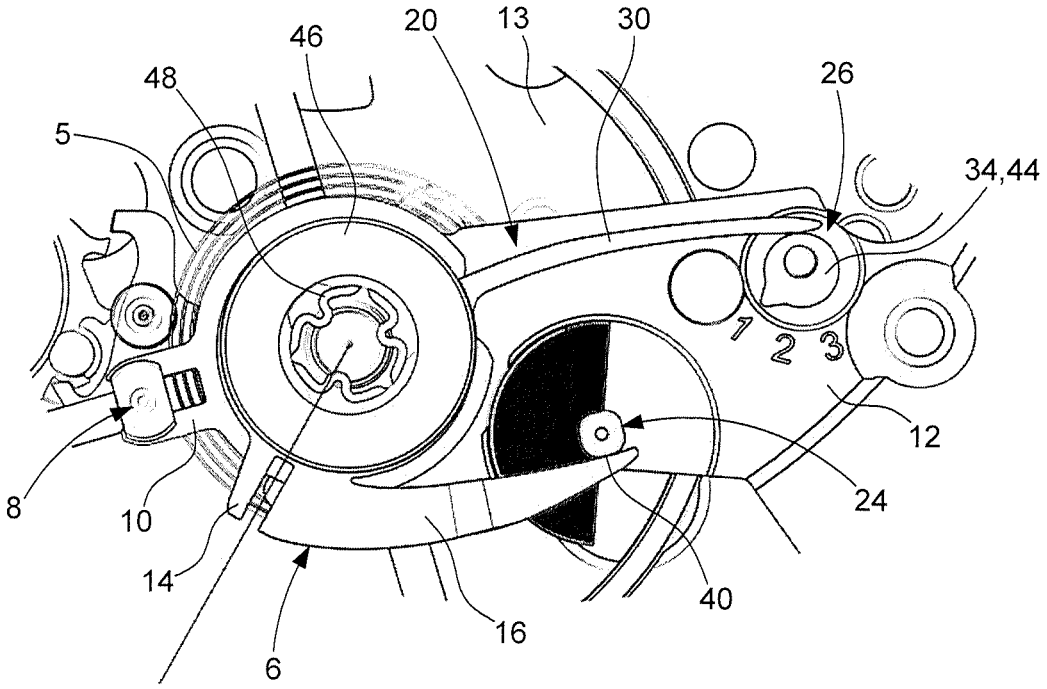
FIG. 3 is a top view of the adjustment device of FIG. 1 in a rest position of the device.
Figure 4:
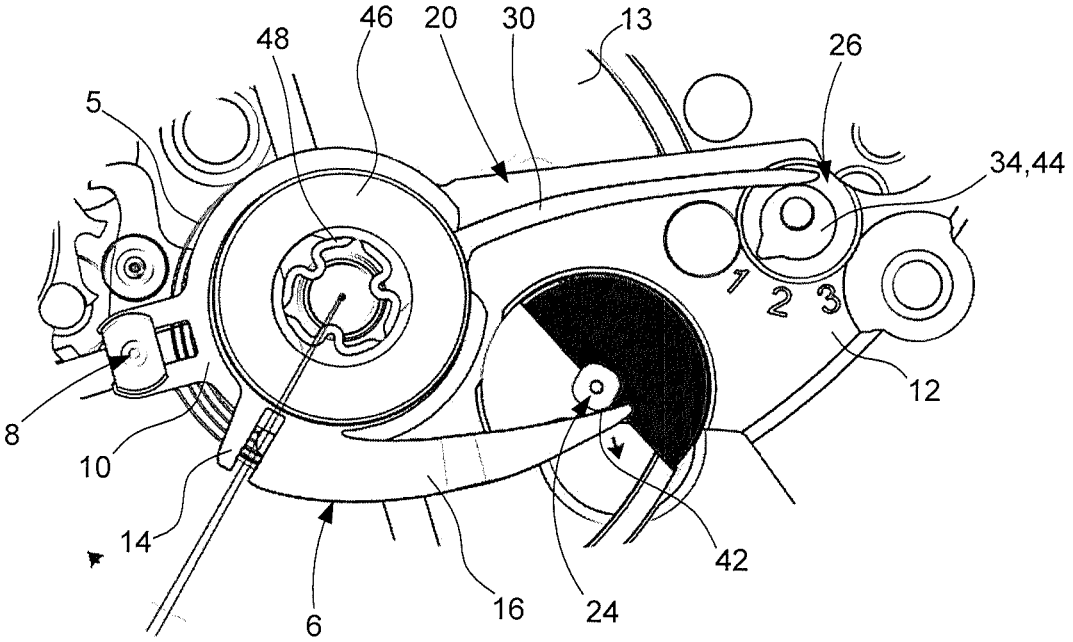
FIG. 4 is a similar view to that of FIG. 3, in a correction position of the device.

Preferably, cam 24 is a radial cam with a shaped outer circumference. Although a radial cam 24 with a substantially rectangular outer circumference is represented in FIGS. 1 to 4, in practice any type of shape can be envisaged for the outer circumference of cam 24, depending on the type of balance spring 5 used. For example, a radial cam with a triangular, oblong or oval outer circumference can also be used within the scope of the present invention. Preferably, and as represented in FIGS. 3 and 4, in the rest position of adjustment device 6, a flat portion 40 of cam 24 is in contact with pivot arm 16 of regulator 14, whereas in the correction position of device 6, a corner or an angle 42 of cam 24 is in contact with pivot arm 16. Also, preferably, as seen in FIGS. 1, 3 and 4, cam 24 is in contact with pivot arm 16 of regulator 14, regardless of the position of inertia block 22.

In the particular example embodiment illustrated in FIGS. 1 to 4, wherein the one-piece part formed by regulator 14, pivot arm 16 and elastically deformable arm 30 substantially defines a U shape, cam 24 is arranged between pivot arm 16 and elastically deformable arm 30 such that cam 24 acts as support for pivot arm 16 and thus participates in subjecting elastically deformable arm 30 to elastic stress. In this particular example embodiment, support part 34 for elastically deformable arm 30 is also arranged between pivot arm 16 and elastically deformable arm 30, in the hollow between the two arms of the U.

Elastic stress adjusting means 26 can serve as support part 34 for elastic deformable arm 30. In a particular example embodiment, illustrated in FIGS. 1 to 4, elastic stress adjusting means 26 include an elastic stress adjustment button 44, which can move between several adjustment positions. Adjustment button 44 is preferably actuatable from outside timepiece 1 by a user, by any means known to those skilled in the art, such as, in particular, a push button or a bezel.

Elastic stress adjustment button 44 has, for example, an outer profile defining a radial contour of variable radius. In the illustrative example of FIGS. 1 to 4, wherein adjustment button 44 acts as support piece 34 for elastically deformable arm 30, this allows the position of arm 30 to be changed relative to pivot arm 16, and thus the intensity of the elastic stress exerted on regulator 14, according to the position of adjustment button 44. The threshold for releasing the cam 24/inertia block 22 assembly is thus changed as a function of the position of adjustment button 44, which allows adjustment device 6 to be adapted according to user's desired use. For example, in the case where timepiece 1 is a watch, adjustment button 44 may be movable between three adjustment positions corresponding to use in the sedentary mode, normal mode or sports mode of the watch.

Shock absorption means 28 are arranged on regulator 14 and at least partially rest on staff 7 of balance 4. Shock absorption means 28 include, for example, an ordinary shock absorber 46 into which a clover spring 48 is driven.

It is therefore envisaged that, according to the position of timepiece movement 2 in space, inertia block 22 which is subject to gravity, can rotate about its axis of rotation and thus cause a displacement of pivot arm 16 of regulator 14, as illustrated in FIGS. 3 and 4. This rotation of inertia block 22 thus simultaneously acts on means 18 for adjusting the active length of balance spring 5, allowing the active length of the spring to be continuously adjusted to offset disturbances to the isochronism of the balance caused by gravity.

The invention claimed is:

1. A device for autonomous adjustment of the active length of a balance spring, for an oscillator of the balance/balance spring type, comprising a regulator mounted on a plate of a timepiece movement, with a cock in which a balance staff pivots, the balance spring comprising an inner end integral with the balance staff and an outer end integral with a balance spring stud attached to a stud holder, the stud holder being pivotally mounted on the cock concentrically to the balance staff, the regulator being pivotally mounted on the stud holder concentrically to the balance staff and comprising a pivot arm and means for adjusting the active length of the balance spring by pivoting the regulator; the device further includes comprising:

elastic stress means configured to exert an elastic, return-to-position action on the regulator; and an inertia block mounted for free rotation on the cock and connected to the pivot arm of the regulator such that a rotation of the inertia block causes a displacement of the pivot arm of the regulator and simultaneously acts on the means for adjusting the active length of the balance spring.

2. The device for autonomous adjustment of the active length of a balance spring according to claim 1, wherein the device further comprises a cam for driving the pivot arm of the regulator, said cam being integral with the inertia block and in contact with the pivot arm.

3. The device for autonomous adjustment of the active length of a balance spring according to claim 2, wherein the inertia block is mounted for free rotation on the cock via an arbor integral with the inertia block, the cam being mounted on the inertia block concentrically to said arbor and integral with said arbor.

4. The device for autonomous adjustment of the active length of a balance spring according to claim 3, wherein the cam is a radial cam with a shaped outer circumference.

5. The device for autonomous adjustment of the active length of a balance spring according to claim 2, wherein the cam is a radial cam with a shaped outer circumference.

6. The device for autonomous adjustment of the active length of a balance spring according to claim 2, wherein, in the rest position of the device, a flat portion of the cam is in contact with the pivot arm of the regulator, and, in the correction position of the device, a corner or an angle of the cam is in contact with the pivot arm.

7. The device for autonomous adjustment of the active length of a balance spring according to claim 2, wherein the cam is in contact with the pivot arm of the regulator regardless of the position of the inertia block.

8. The device for autonomous adjustment of the active length of a balance spring according to claim 1, wherein the elastic stress means comprise an elastically deformable arm, with a first end of the arm resting against a part integral with the cock and a second end of the arm being attached to the regulator.

9. The device for autonomous adjustment of the active length of a balance spring according to claim 8, wherein the regulator, the pivot arm and the elastically deformable arm together form one piece.

10. The device for autonomous adjustment of the active length of a balance spring according to claim 1, wherein the device further comprises means for adjusting the elastic stress defined by the elastic stress means.

11. The device for autonomous adjustment of the active length of a balance spring according to claim 1, wherein the means for adjusting the active length of the balance spring comprise two pins attached to the regulator, the balance spring being arranged such that an outer coil of the balance spring passes between the two pins.

12. The device for autonomous adjustment of the active length of a balance spring according to claim 1, wherein the device further comprises shock absorption means, arranged on the regulator and at least partially resting on the balance staff.

13. The device for autonomous adjustment of the active length of a balance spring according to claim 1, wherein the inertia block is a half-solid disc.

14. The device for autonomous adjustment of the active length of a balance spring according to claim 1, wherein the inertia block is a solid bimaterial disc, the two materials having distinct densities.

15. A timepiece movement comprising an oscillator of the balance/balance spring type and a device for adjusting the active length of the balance spring, wherein the autonomous adjustment device is the device according to claim 1.

16. A timepiece comprising a timepiece movement, wherein the timepiece movement is the movement according to claim 15.

17. A device for autonomous adjustment of the active length of a balance spring, for an oscillator of the balance/balance spring type, comprising a regulator mounted on a plate of a timepiece movement, with a cock in which a balance staff pivots, the balance spring comprising an inner end integral with the balance staff and an outer end integral with a balance spring stud attached to a stud holder, the stud holder being pivotally mounted on the cock concentrically to the balance staff, the regulator being pivotally mounted on the stud holder concentrically to the balance staff and comprising a pivot arm and means for adjusting the active length of the balance spring by pivoting the regulator; the device further comprising:

elastic stress means configured to exert an elastic, return-to-position action on the regulator; and an inertia block mounted for free rotation on the plate and connected to the pivot arm of the regulator such that a rotation of the inertia block causes a displacement of the pivot arm of the regulator and simultaneously acts on the means for adjusting the active length of the balance spring.

18. The device for autonomous adjustment of the active length of a balance spring according to claim 17, wherein the device further comprises a cam for driving the pivot arm of the regulator, said cam being integral with the inertia block and in contact with the pivot arm.

19. The device for autonomous adjustment of the active length of a balance spring according to claim 18, wherein the inertia block is mounted for free rotation on the plate via an arbor integral with the inertia block, the cam being mounted on the inertia block concentrically to said arbor and integral with said arbor.

20. The device for autonomous adjustment of the active length of a balance spring according to claim 18, wherein, in the rest position of the device, a flat portion of the cam is in contact with the pivot arm of the regulator, and, in the correction position of the device, a corner or an angle of the cam is in contact with the pivot arm.

21. The device for autonomous adjustment of the active length of a balance spring according to claim 18, wherein the cam is in contact with the pivot arm of the regulator regardless of the position of the inertia block.

22. The device for autonomous adjustment of the active length of a balance spring according to claim 17, wherein the device further comprises means for adjusting the elastic stress defined by the elastic stress means.

23. The device for autonomous adjustment of the active length of a balance spring according to claim 17, wherein the means for adjusting the active length of the balance spring include two pins attached to the regulator, the balance spring being arranged such that an outer coil of the balance spring passes between the two pins.

24. The device for autonomous adjustment of the active length of a balance spring according to claim 17, wherein the device further comprises shock absorption means, arranged on the regulator and at least partially resting on the balance staff.

25. The device for autonomous adjustment of the active length of a balance spring according to claim 17, wherein the inertia block is a half-solid disc.

26. The device for autonomous adjustment of the active length of a balance spring according to claim 17, wherein the inertia block is a solid bimaterial disc, the two materials having distinct densities.

27. A timepiece movement comprising an oscillator of the balance/balance spring type and a device for adjusting the active length of the balance spring, wherein the autonomous adjustment device is the device according to claim 17.

28. A timepiece comprising a timepiece movement, wherein the timepiece movement is the movement according to claim 27.

* * * * *